US005575015A

United States Patent [19]

Paris et al.

[11] Patent Number: 5,575,015

[45] Date of Patent: Nov. 19, 1996

[54] INNER SOCK FOR SPORTS BOOT

[75] Inventors: Jean Paris, Sevrier; Laurent Bonaventure, Cran-Gevrier, both of France

[73] Assignee: Salomon S.A., Annecy, France

[21] Appl. No.: 352,134

[22] Filed: Dec. 1, 1994

[30] Foreign Application Priority Data

Dec. 3, 1993 [FR] France ..... 93 14672

[51] Int. Cl.[6] ..... A41B 11/02; A43B 17/18; A43B 19/00; A43B 5/04

[52] U.S. Cl. ..... 2/240; 2/241; 36/10; 36/117.1

[58] Field of Search ..... 2/239, 61, 240, 2/241, 242; 36/10, 119, 120

[56] References Cited

FOREIGN PATENT DOCUMENTS 066133 8/1982 European Pat. Off. .
2360271 3/1978 France .

OTHER PUBLICATIONS

Search Report FR 93 14672.

*Primary Examiner*—C. D. Crowder
*Assistant Examiner*—Larry D. Worrell, Jr.
*Attorney, Agent, or Firm*—Pollock, Vande Sande & Priddy

[57] ABSTRACT

Comfort sock designed to be arranged inside the shell of a sports boot, such as a ski boot. The sock (1) incorporates a one-piece structure comprising a foot covering (6) with a vamp (7) and an upper (8), a reinforcement (13), and at least one comfort support liner (11) independent of the covering (6) and connected to the reinforcement (13) of pivoting-sliding connections (16). This support liner (11) is arranged opposite an elastic area (9) of the foot covering (6), against which it comes into close contact at the time of closure of the shell of the boot in which the sock (1) is positioned.

10 Claims, 5 Drawing Sheets

INNER SOCK FOR SPORTS BOOT

FIELD OF THE INVENTION

The present invention relates to a comfort sock arranged inside the shell of a sports boot, such as a ski boot, and, in particular, to a sock incorporating a one-piece structure which fits over the foot and lower leg of the wearer of the sock, while extending to the upper edge of the boot upper.

BACKGROUND OF THE INVENTION

Conventional socks of this kind fall into two major categories:

- socks with a covering into which the foot fits and comprising an opening for insertion of the foot, which is closed with a flap or tongue, and
- socks in which the foot-insertion covering uniformly encloses the foot and lower leg without breaks and, which, comprises at least one extensible area which becomes stretched when the foot is inserted into the sock, and then tightens around the lower leg of the skier.

The first category of socks is disclosed, for example, of in FR 2,368,239 and EP 066,133. In FR 2,368,239, the foot-insertion opening is formed by slits laterally arranged along the area covering the lower leg of the skier. Thus, the sock incorporates a front portion covering the foot and the front of the lower leg, and a rear tongue-shaped portion covering the heel and the rear part of the lower leg. To facilitate insertion of the foot, the sock is, in the resting state, in open position. This structure has a first disadvantage resulting from the superposition of the edges of the sock covering in the area of the lateral slits. This disadvantage is amplified by the bevelled form imparted to these edges of the covering and by the arrangement of the pliable membranes which attach them. In fact, because of this arrangement, the least lateral sliding motion of the edges of the sock covering during skiing or when the sock is put on generates, laterally to their superposition, an interior fold which increases in size as the sliding motion becomes more pronounced, thus forming points of compression which are painful to the skier. A second problem arises from the fact that, in the resting state, sock is in the open position. In fact, as soon as the means used to tighten the upper have been released, the upper is forced to open completely under the effect of the force generated by the sock, which tends to return to its initial position. This arrangement thus requires, first, the use of closure elements to ensure that the foot will be covered when putting on the boot, and second, to provide elements or means for holding the upper of the boot in a relaxed position, i.e., not open, to allow walking, for example.

In EP 066 133, the sock comprises a covering fitting over the foot produced from a single piece, and an opening for insertion of the foot consisting of a single slit in the rear part of the sock, this slit being delimited by a pair of overlapping flaps. A closure system is combined with the flaps to ensure that the sock covers the foot and lower leg of the skier. Because of the superposition of the flaps, this sock has the same disadvantage as that of the sock according to FR 2,368,239, i.e., that slippage of the flaps occurring during skiing causes a change of position of the interior flap, or fold thus formed, in contact with the skier's leg and along the rear portion thereof. Another problem results from the use of the closure systems associated with the flaps. In fact, this system, which is accessible only when the boot upper is open, has the disadvantage of producing a sensation of immobilization of the lower leg which is unrelated to the system for closure of the boot upper. For example, the tightening of the sock may be relatively forceful and thus provide for close contact over the lower part of the leg, while closure of the boot upper may allow a certain degree of looseness to persist between the sock covering and the inner wall of the upper.

As regards the second category of socks, FR 2,360,271 and IT 1,117,339 disclose socks whose foot-insertion covering encloses the foot and lower leg of the skier uniformly and without breaks. As compared with the above-discussed socks, these socks have the advantage of incorporating no overlap or superposition of the configuration of the flaps and/or tongue.

FR 2,360,271 discloses an inner sock whose ascending upper section is closed over its entire circumference and has a higher degree of circumferential extensibility than do the other parts of the sock.

To this end, this wall is divided into strips which extend transversely to the circumference and which are contiguous in an alternating, accordion-like arrangement.

Accordingly, the sock may expand to allow the passage of the foot by unfolding the accordion-like strips resembling a kind of bellows.

Nevertheless, this design has a number of disadvantages, since stretching the strips causes the thickness of the sock wall to vary, and, moreover, imparts to the latter a flexibility which is not necessarily sought, in particular in the rear portion of the sock, which must form a solid support against the boot shell.

In addition, this unfolding of the strips produces an opposite effect, depending on the skier's body size. In fact, if the skier is big, he will tend to cause the strips to stretch markedly, and thus to decrease their strength, even though, in this case, this strength should be increased, and vice-versa. The quality of the support is thus directly influenced by differences in of the circumference of the skier's lower leg.

Moreover, this design entails the use of a material of the same kind. Experience has shown that a sock which is both comfortable and effective during skiing should give a relatively firm rear support and a front support under flection, depending on the degree of elasticity chosen as a function of the level of comfort desired.

In IT 1,117,339, the inner sock has with an ascending upper section closed over its entire circumference and with two lateral elastic zones intended to impart to it greater elasticity, in order to allow insertion of the foot. The upper section of the sock is provided with a rear and a front liner separated by the elastic zones. These liners are designed, to act as means for adjusting the fit of the sock between the inside surface of the boot shell and the skier's lower leg; and to act as support and comfort elements with respect to the lower leg. The result of this structure is that the stretching of the elastic zones does not modify the characteristics of the liners, and thus does not affect the quality of the front and rear supports. To the contrary, because the liners cannot be detached from the elastic zones, it is not possible to give greater importance to these elastic zones without doing so to the detriment of the surfaces of the liners, and thus, of the skier's comfort. Thus, whatever the solution chosen, the structure of such a sock can produce only a compromise between the sought-for ease of fitting the sock on the foot, which requires the substantial degree of extensibility and thus, of a large extensible surface are, and the comfort of the skier, which requires large support and covering surface areas. Moreover, because the front and rear liners are attached to the elastic zones, which, in use, necessarily undergo rapid wear and loosening, the relative position of these liners cannot remain stable during skiing and use over time, since there is an inherent weakening of the materials used to make these elastic zones.

SUMMARY OF THE INVENTION

The present invention seeks to solve the problems arising from one-piece socks of the type described above. In particular, it is intended:

- to allow the sock to be put on and taken off easily without requiring any manipulation by the skier as regards the insertion or covering of the foot,
- to provide for uniform covering of the foot and lower leg, without breaks,
- to guarantee the immobilization of the foot and/or lower leg in such a way as to complement the action produced by the boot-closure means, and
- to ensure the uniform quality of the firmness of the supports and of the comfort provided, regardless of the circumference of the skier's lower leg.

Another problem which the invention proposes to solve consists in facilitating individualized adjustment of at least one of the support liners of the sock and working in conjunction with the skier's lower leg as a function of the characteristics, morphology, strength, weight, skiing technique, etc., of the skier, without requiring these factors to be considered during manufacture, but rather only when the boot equipped with this sock is purchased by the skier.

To achieve these objectives, the inner sock according to the invention is interposed between the lower leg and foot of the skier and the shell of a sports boot, e.g., a ski boot, and has a one-piece structure incorporating, elastically-extensible means designed to facilitate the entry of the foot when the boot is put on and taken off and support and comfort-enhancing liners for the skier's lower leg. The sock comprises a vamp and an upper, which enclose the foot and the lower leg without breaks, so that they form a comfortable foot covering or sock which delimits the volume of the sock uniformly and without breaks. This covering is provided with means that are extensible over at least one area of the upper, which opens out over the foot-insertion circumference. This elastic zone is designed to allow the sock to be put on without any manipulation by the skier; i.e., when the skier's foot is inserted, this zone stretches, then tightens again over his lower leg. A relatively rigid, even semi-flexible, reinforcement is incorporated into the outer wall of the foot covering, and at least one comfort-enhancing support liner having a groove-shaped section and made independent of the foot covering is attached to this reinforcement by at least one of its lateral wings by means of at least one advantageously-detachable sliding connection is arranged opposite an area of pronounced extensibility of the foot covering. As a result of this structural feature, the elastic zone and the liner, while being independent, can cooperate intimately with each other, in particular when the boot is closed. To this end, the sliding connection(s) are positioned approximately in the direction facing the part of the foot or lower leg to be held by the support liner, and are endowed with a freedom of transitional travel which makes it possible to spread the support liner widely apart to allow the skier's foot to be inserted in the foot-insertion covering, and then to draw it closer against the skier's foot and/or lower leg when the boot shell is closed once again over the sock. It is obvious that the boot shell incorporates opposite the movable support liner at least one tightening element that can be moved toward the liner when the boot is closed, and that can move back freely when the boot is opened. Accordingly, because the support liner is connected in a sliding arrangement to the relatively rigid reinforcement of the sock, its position remains constant while allowing pronounced stretching of the extensible area of the foot covering located opposite thereto. In addition, because, in the closed boot position, the liner is pressed against the extensible zone and, therefore, against the part of the skier's foot or lower leg, the support thus obtained is equivalent to the support which would be produced using a one-piece structure, i.e. it is not affected by variations in the volume of the foot or of the circumference of the skier's lower leg. Once again, this construction avoids having to provide the sock with closure or position-retention means in order to ensure, once the boot is put one, good covering of the foot and of the lower leg which is at least sufficient to enable walking with the boot open, for example, since it is the extensible zone which performs that function. Furthermore, this structure guarantees the immobilization of the foot and/or lower leg interdependently of the action of the boot-closure means, since it is by tightening the shell and/or the boot upper that the support liners of the sock are positioned under pressure against the foot and/or lower leg. The perceived tightening stress on the foot and/or lower leg is thus correlated with the tightening stress generated in the shell when the boot is closed.

According to an embodiment of the invention, the position of the support liner connected slidably to the reinforcement of the sock can also be adjusted in relation to the extensible elastic zone with which it cooperates: e.g., over the vertical dimension if the extensible zone is located on the upper of the foot covering.

Of course, the support liner connected in a sliding arrangement to the reinforcement is free to swing and/or to pivot around the connection, thus permitting adjustment of its inclination to correspond to the area of the lower leg or foot positioned opposite to it. To this end, the support liner has no jointed connection other than that which connects the sock reinforcement. Accordingly, its base, or lower end, remains free to swing, in order to free the areas of passage or protrusion of the foot, such as the instep and/or the heel areas on the foot covering, which are preferably made of an extensible material, at least in the parts opposite the support liner in question.

According to a variant, the support liner of the sock may be held in place on the foot covering by an elastic part exhibiting very low resistance, so that its lower end can always move freely in any direction, while undergoing stresses tending to keep it centered.

The sock according to the invention is not limited to one type of ski boot. Thus, in the case of so-called "front or central opening" boots, an extensible zone in the foot-insertion covering of the sock provided with a sliding/pivoting support liner is produced on at least the front portion of the latter, which is substantially in contact with the front portion of the skier's lower leg and instep.

Conversely, in the case of so-called "rear-entry" boots, an extensible zone of the foot covering incorporating a sliding/pivoting support liner is produced in at least the rear portion of the sock.

According to one detail of the invention, the relatively rigid reinforcement incorporated on the outside of the foot covering of the sock has clearance openings and notches substantially corresponding to the areas of passage of the protruding areas of the foot and/or the lower leg.

In combination with these clearance openings and/or notches produced on the reinforcement, the foot covering is preferably made with elastic zones extending in a matching configuration with and inside these openings/notches. In addition, the support liners attached to the reinforcement may advantageously be provided with an enclosing surface which does not cover the entire surface area of the elastic zone(s) located opposite thereto, and which, in particular, does not extend over of the clearance openings in the reinforcement.

Advantageously, because the sock has a relatively rigid reinforcement, the latter can be made with a position-retention element interposed between the reinforcement and the shell of the boot by being inserted elastically into a corresponding element on the inner wall of the boot, in order to ensure the correct placement of the sock in the shell and its position retention when the foot is withdrawn from the boot. In addition, another position-retention or fastening element may be provided to ensure the connection and/or position-retention of another part of the upper edge of the boot upper with that of the boot shell, this element thus being used to prevent the foot covering from sliding in the boot when the foot is inserted.

According to another variant of the invention, the support and comfort-enhancing liner positioned opposite the corresponding elastic zone is produced as a single piece with the reinforcement of the foot covering, of which it forms a tongue-shaped extension. In this construction, the tongue extends over a length such that it covers the elastic zone opposite, so as to be reconnected by its free end to the reinforcement of the side opposite the side from which it emanates. As in the preceding examples, a pivoting-sliding connection which may be a simple elastic strip, is arranged on that end. In fact, when the support liner is produced in this way, its position-maintenance in relation to the foot covering is virtually ensured by the rigidity of the reinforcement, so that its free end does not require the use of a rigid connection. This tongue is obviously padded with a comfort-enhancing material on the side corresponding to the part of the foot or lower leg with which it is designed to cooperate, thus forming the support liner.

BRIEF DESCRIPTION OF THE DRAWINGS

The invention will be better understood by referring to the following description provided in conjunction with the attached schematic drawings illustrating, by way of example, several variants of the sock.

DETAILED DESCRIPTION

Figure 1:
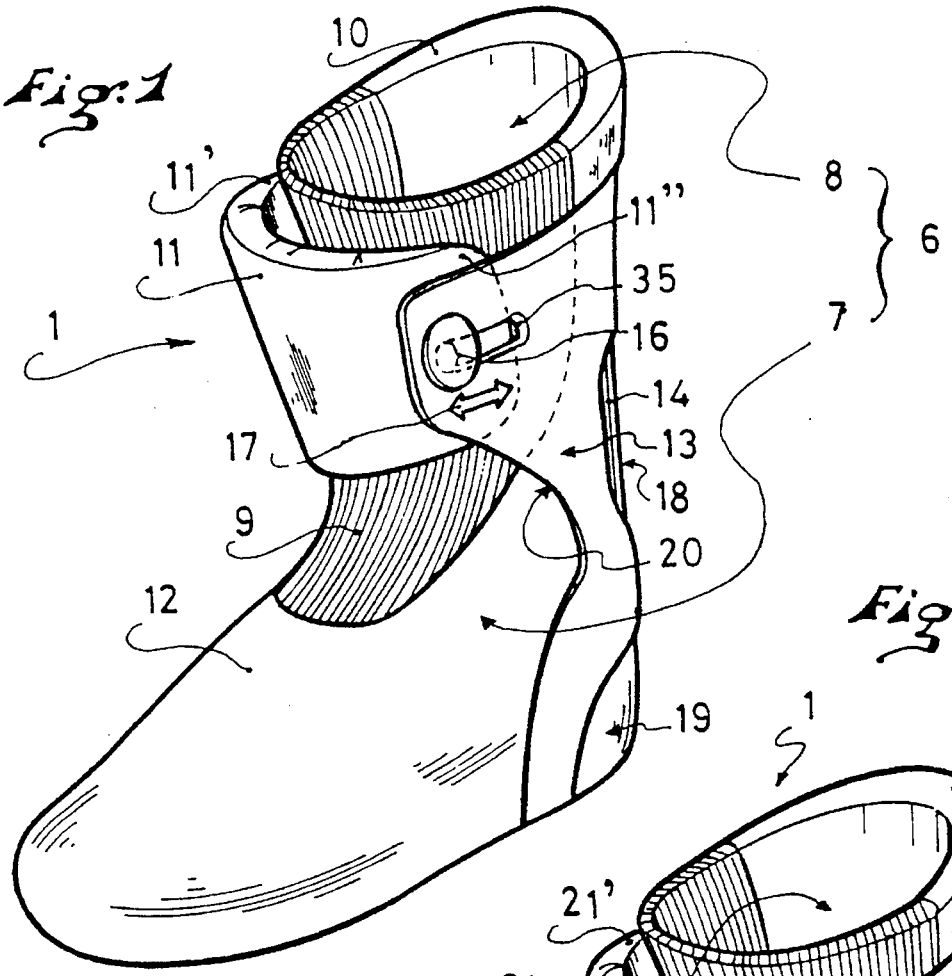
FIG. 1 is a perspective view of a first embodiment of a sock according to the invention, in which the front support liner exists in the form of a horizontal transverse strip extending above the instep area, shown in the initial position corresponding to the open boot position.
Figure 2:
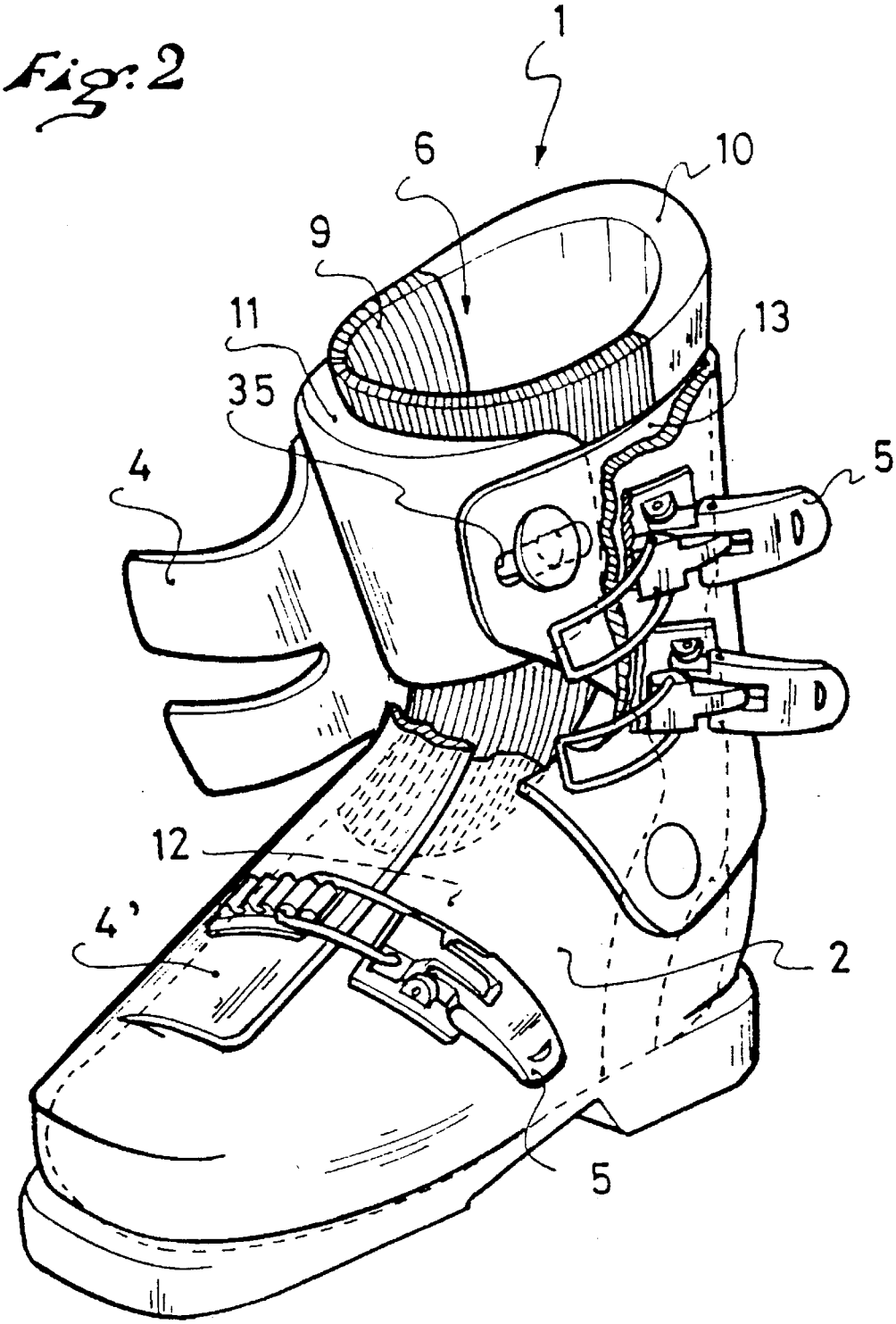
FIG. 2 illustrates the sock of FIG. 1 inserted into the shell of a ski boot shown in a partial cut-away view, illustrating a front-opening boot.

The inner sock 1 according to the invention, as shown in FIG. 1 and 2, is designed to be inserted in the shell 2 of a ski boot which, in this example, is of the "front entry" or "center entry" type. In this boot, the upper front portion of the shell 2 is equipped with flaps 4, 4' that are spread apart to allow insertion of the foot and that are tightened using tensioning devices 5 used to close the boot. By drawing the devices 5 over the flaps 4, 4', the latter are brought more or less closer to the sock and, accordingly, to the skier's foot. This sock 1, which has a one-piece structure, comprises, first, a foot covering 6 comprising a vamp 7 and an upper 8 comprising an elastic zone 9 designed to facilitate the passage of the foot when the boot is put on and taken off, and second, at least one comfort-enhancing support liner 10, 11, 12 which cooperates with the foot and/or the lower leg of the skier. The sock is provided with a reinforcement 13 mounted on the outer wall of the foot covering 6, and one comfort-enhancing support liner 10 is made independent of the foot covering 6. This support liner 10, which has substantially a groove-shaped section, is arranged opposite the elastic zone 9 has wings 11, 11' connected to each of the sides of the reinforcement by means of a pivoting-sliding connection 16, by cooperation with an opening 35 directed substantially toward the lower leg to be held in place. Moreover, each pivoting connection 16 is configured so as to move in translation in the directions indicated by arrow 17 over a certain length in order to move aside substantially the support liner 11 and not impede or prevent the maximum expansion of the elastic zone 9 when the skier's foot is inserted into the foot covering 6. Accordingly, when the foot has been inserted into the sock 1 and the upper of the shell 2 is closed, the generation of tension on the flaps 4 by means of the tensioning devices 5 causes the upper of the shell 2 to be tightened over the sock. Consequently, the flaps 4, which are movable tightening elements, push the support liner 11 back toward the elastic zone 9, with which it comes into close contact. The liner 11 thus supports the part of the lower leg beneath this elastic zone, by also adjusting its inclination by virtue of the pivoting capability imparted by the joints 16.

According to one embodiment, the rear portion of reinforcement 13 incorporates clearance openings 18 and 19"; one of which (18) allows the unrestricted passage of the skier's heel when the boot is put on or taken off, and the of which (19) houses the heel in the foot covering 6. Because the sock 1 is designed for front or center entry boots, the front portion of reinforcement 13 also incorporates notches 20, so as to leave free all upper front areas of the foot covering 6, which extends from and above the instep. Advantageously, the release opening(s) 18, 19 match up with the elastic zones 14 on the foot covering 6.

Figure 3:
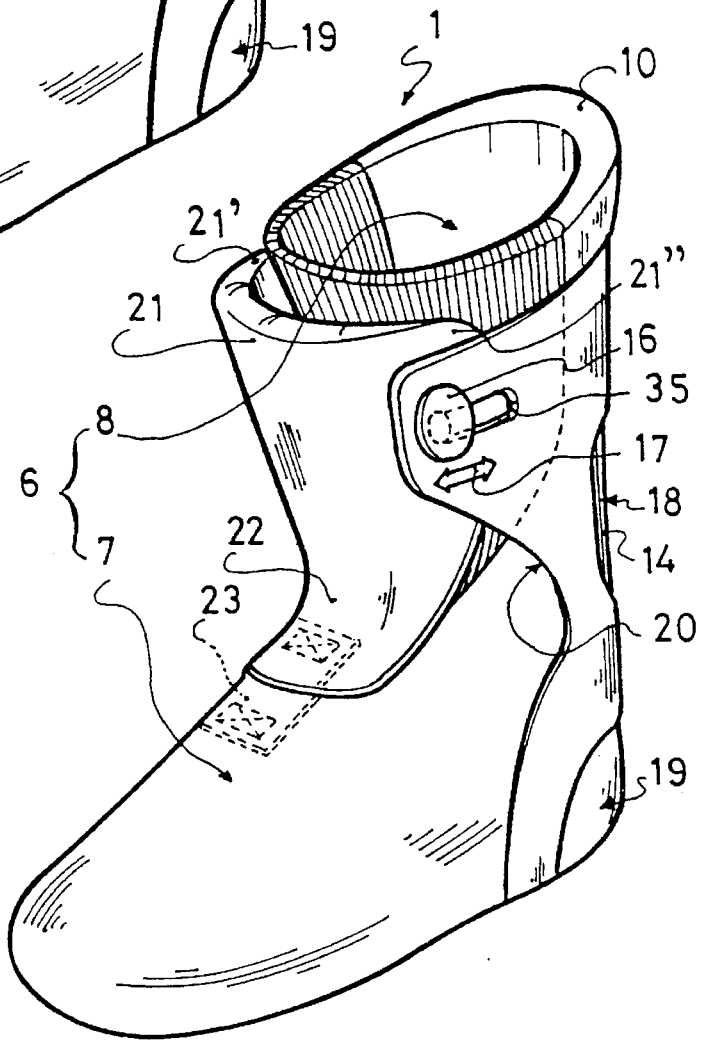
FIG. 3 is another perspective view of a sock similar to that in FIG. 1, but in which the front support liner extends to the zone corresponding to the instep area.

In this the, shown in FIG. 1, the support liner 10 does not cover the instep area; however, FIG. 3 shows a support liner 21; which encloses this zone. To allow unrestricted pivoting in all directions of the lower end 22 of the liner 21 in relation to the foot covering, the liner 21 either has no jointing connection other than connection 16 on its wings 21', 21" located on either side of the sock, or it incorporates additionally an elastic, strip-shaped connection piece 23 of very low resistance. Accordingly, the support liner 21, while being stressed so as to remain centered, is free to move in the direction of arrow 17 and to adjust to the shape of the instep and/or of the lower leg.

Figure 4:
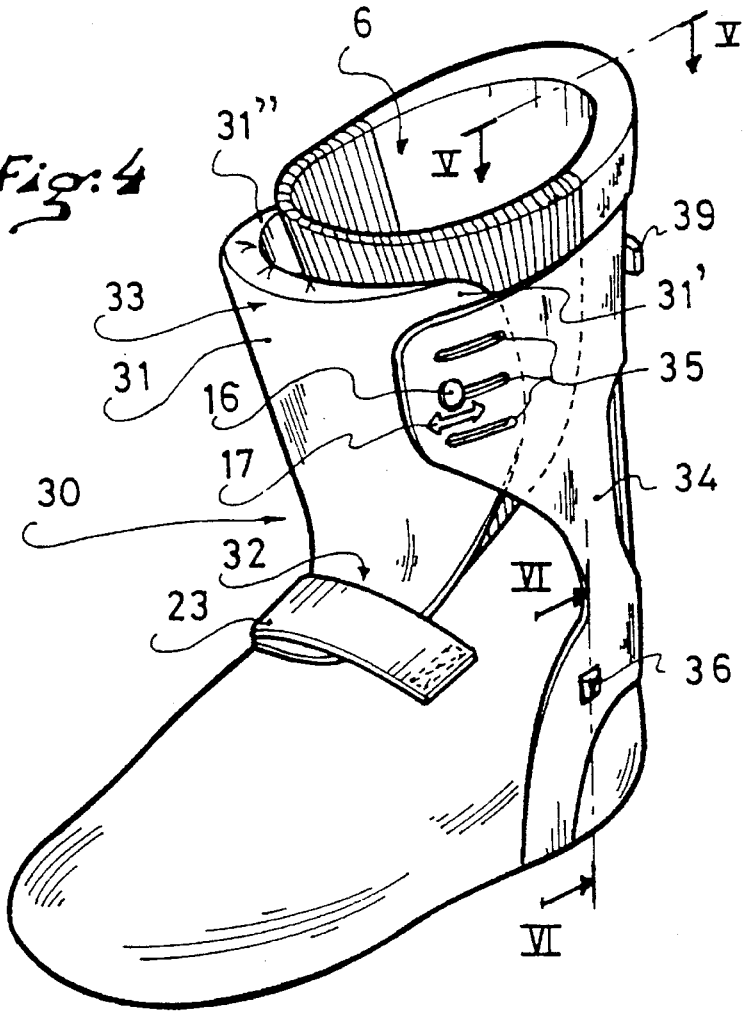
FIG. 4 is a perspective view illustrating an embodiment of the sock with a height-adjustable support liner.

According to the embodiment shown in FIG. 4, the sock 30 fitted with a foot covering 6 comprises a support liner 31 the lower portion 32 of which is kept centered on the sock covering using a connection piece 23 in the shape of a transversely arranged strip, and whose upper portion 33 is vertically adjusted on a reinforcement 34. To this end, the reinforcement 34 is provided with several elongated openings 35 capable of receiving a connection 16, which is preferably made detachable. Thus, depending on the height of the desired lower leg support, the liner 31 need only be positioned on the reinforcement 34, by means of the connections 16 of its wings 31', 31", in the corresponding opening 35 which determines the possible direction of travel 17 of the liner 31, the elastic connection 23 becoming deformed as a consequence.

Figure 5:
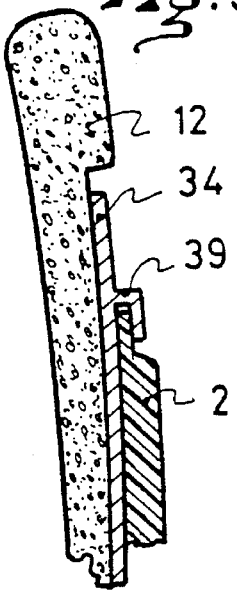
FIGS. 5 and 6 illustrate embodiment details adapted to the sock shown according to the cross-section lines V—V and VI—VI, respectively.
Figure 6:
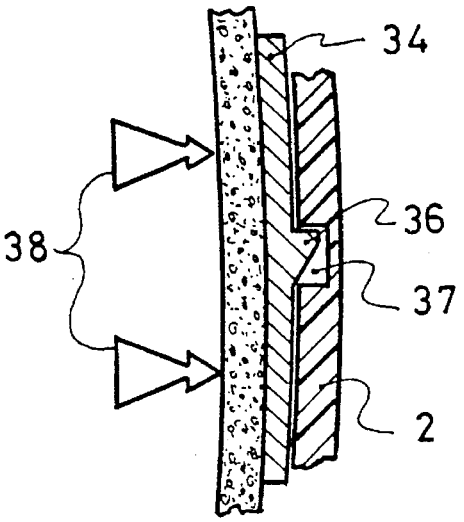
Figure 7:
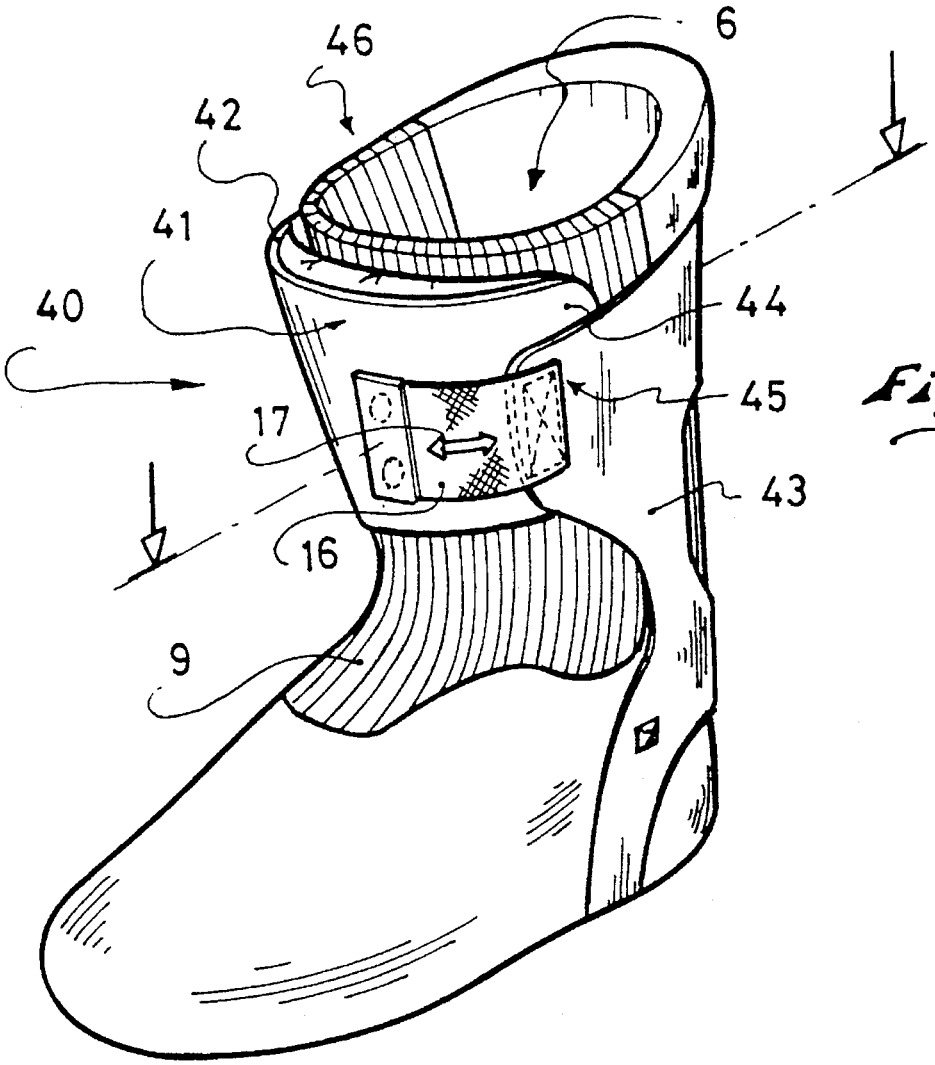
FIG. 7 is a perspective view of a sock according to the invention, in which the reinforcement incorporated on the outside of the foot covering forms, when viewed in the horizontal plane similar to cross-section IIX—IIX, a transverse tongue which closes in an overlapping arrangement and which is illustrated in FIG. 8.
Figure 8:
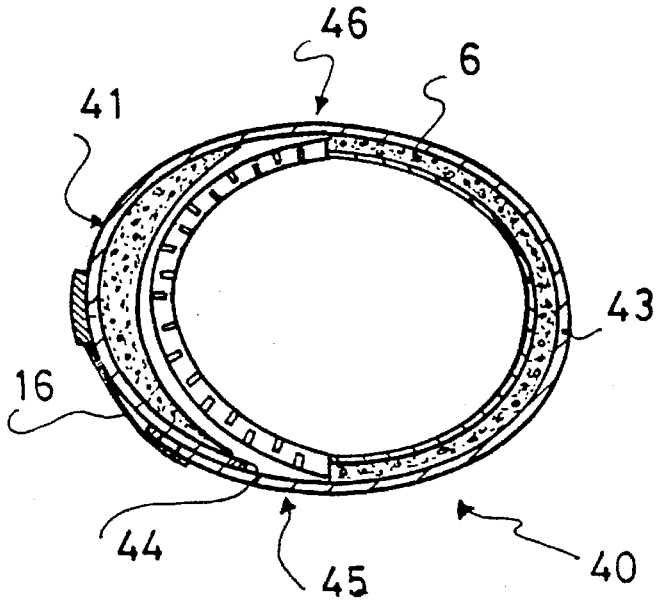

Construction details are also provided as regards the cooperation of the sock 30 with the boot shell designed to house it. For example, a position-retention element 36 such as a pin (FIGS. 4 and 6) is incorporated on the outside of the reinforcement 34 in the heel area. Opposite this position-retention element 36, a corresponding element such as a notch or hole 37 is then produced in the inner wall of the shell 2 of the boot, and the simple lateral resistance of the sock (illustrated schematically by the arrows 38) ensures elastic interlocking when the sock is put in place, and its position-retention when the foot is removed. In addition, as shown in FIGS. 4 and 5, a fastening element 39 is provided that can ensure connection with a portion of the upper edge of the upper of the boot shell 2, for example by means of an overlap. In the preceding examples, the socks 1 and 30 have support liners 11, 21 completely incorporated in the reinforcement 3, 34, and thus have two pivoting-sliding connections 16 that can hold these liners in a relatively balanced manner and in a constant position. In the variant illustrated in FIGS. 7 and 8, the sock 40 fitted with a foot covering 6 may also have a support liner 41 emanating from an extension 42 of the reinforcement 43. In this construction, the support liner 41, shaped like a transverse tongue, extends over a length at least sufficient to allow the partial overlap of its free end 44, or wing, with the side 45 of the reinforcement 43 opposite the side 46 from which it emanates. The reinforcement 43 of the foot covering 6 being relatively stiff, the support liner 41 thus obtained is positioned firmly on the side 46 of the reinforcement, and a single sliding-pivoting connection 16, which may be replaced by an elastic connection strip, connects the free end 44 to the other side 45 of this reinforcement and allows its movement along 17.

Figure 9:
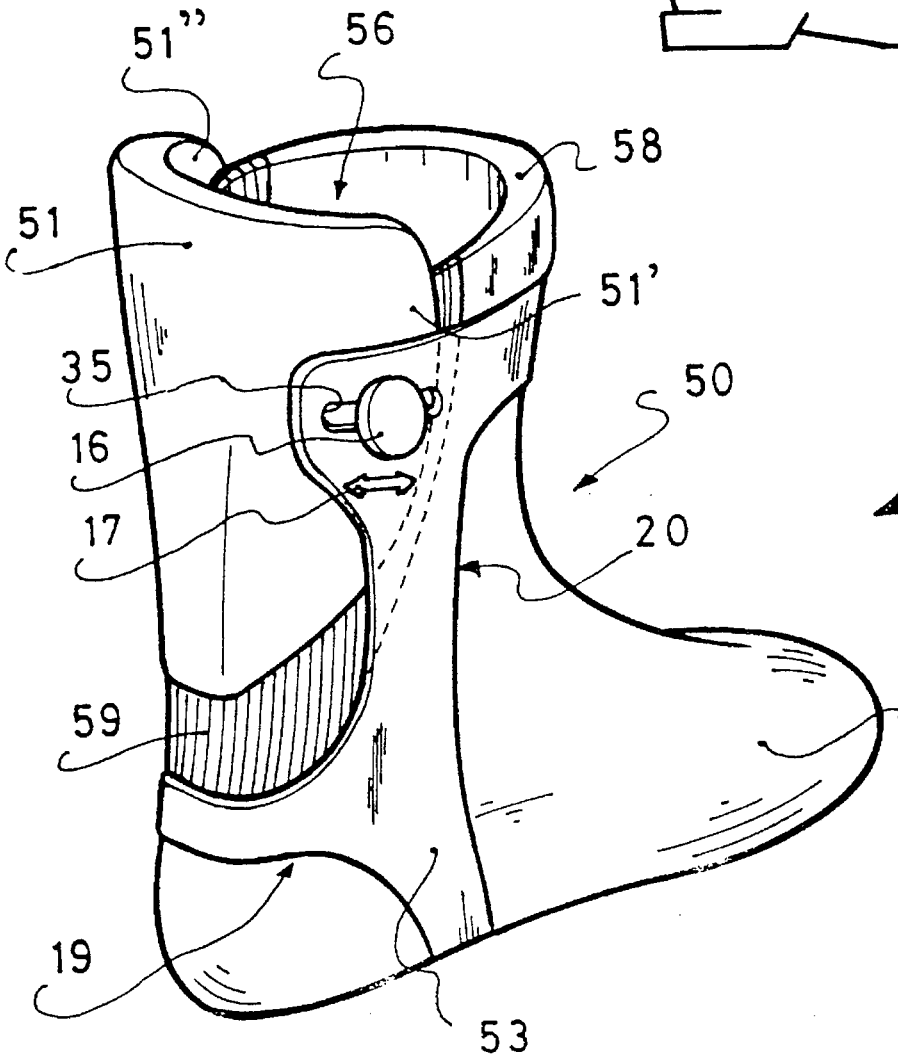
FIG. 9 is a rear perspective view of a sock according to the invention, in which the movable support liner cooperating with the area of pronounced extensibility is located in the rear portion of the sock, this embodiment of the sock advantageously corresponding to its use in so-called "rear entry" boots.

Still according to the invention and as shown in FIG. 9, the center or rear entry sock 50 is equipped with a rear support liner 51 which cooperates with an elastic zone 59 belonging to a foot covering 56. As in the preceding examples, the support liner 51 is connected to the reinforcement 53 by means of its wings 51', 51", using connections 16 which slide in the openings 35, and the areas of passage or protuberance of the foot are freed, e.g., in the area of the heel and instep, by means of openings 19 and 20.

This configuration gives a one-piece structure comprising a foot covering 56 incorporating a vamp 57 and an upper 58, and at least one support liner 51 connected by sliding-pivoting connection 16 to the reinforcement, the support liner 51 thus being independent of foot covering 56.

Figure 10:
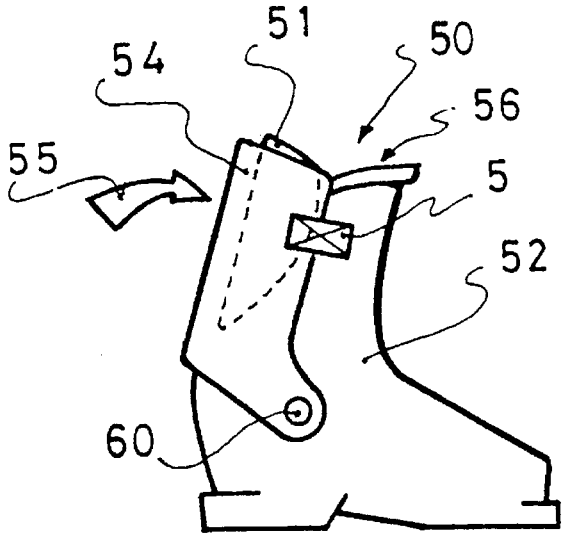
FIG. 10 is a schematic view of a rear entry boot equipped with the sock in FIG. 9.

As previously described, the support liner 51 cooperating with the elastic zone 59 in which the foot passes is put under pressure and/or is placed against the portion of the skier's foot and/or lower leg beneath this elastic zone, by means of an element 54 which tightens the boot shell 52, as illustrated schematically in FIG. 10. This tightening element 54 is constituted by the rear closing cover of the upper and pivots on the base of the shell 52 around pivoting connections 60. Thus, when it is closed by pivoting in the direction of arrow 55 and locked in place using the tensioning device 5, the support liner 51 is pushed and held in position against the rear of the skier's lower leg.

The foot coverings 6, 56 of the socks 1, 30, 40, 50 just described as examples comprise in addition to the extensible zones(s) 9, 14, a wall having a thickness designed to adjust the sock between the inner surface of the shell 2 and the skier's foot.

Moreover, the sock according to the invention may be produced with multiple liners made independent of the foot covering and borne by the reinforcement. As an example (not shown), the sock may comprise both a rear and a front support liner, the reinforcement then being produced with clearance openings and zones matching up with these liners.

Finally, the support liners 10, 21, 31, 51, which are independent of the foot covering 6, 56, may be made detachable from the reinforcement 13, 34, 53 by using detachable connections 16. Accordingly, depending on the morphology of the skier and/or his skiing technique, the support liners 10, 21, 31, 51 can easily be replaced when the ski boot is sold, for example by a relatively hard or compressible liner.

What is claimed is:

1. Comfort sock to be arranged inside the shell of a sports boot having at least one tightening element which can travel toward said sock when said boot is closed, said comfort sock having a one-piece structure comprising a foot covering incorporating at least one elastic zone designed to facilitate passage of a foot when putting on or taking off said sports boot, and at least one comfort support liner cooperating with a lower leg of a wearer, and a reinforcement incorporated on an outer wall of said foot covering, said at least one comfort support liner having a substantially groove-shaped section, said support liner being independent of said foot covering and having at least one wing connecting said support liner to said reinforcement using a pivoting-sliding connection and placed opposite said at least one elastic zone of said foot covering so as to come into close contact with said foot covering when said sports boot is closed by motion of said at least one tightening element used to tighten said shell of said sports boot.

2. Comfort sock according to claim 1, wherein said sliding connections are positioned for translational movement substantially in a direction of a part of the foot or lower leg to be held by means of said support liner, thus making it possible to spread said support liner apart substantially to allow passage of said foot and then to allow it to be drawn closer to said foot when the boot is closed.

3. Comfort sock according to claim 1, wherein said reinforcement of said foot covering of said sock has foot-clearance openings located in areas allowing passage of protuberances of the foot, and said foot covering comprises said at least one elastic zone positioned in correspondence with and inside said foot covering.

4. Comfort sock according to claim 3, wherein said support liner connected to said reinforcement of said foot covering extends over a surface area smaller than said elastic zone positioned opposite, and with which it cooperates.

5. Comfort sock according to claim 1, wherein said reinforcement of said foot covering of said sock comprises a position-retention element cooperating with a corresponding element provided in an inner wall of the shell of said boot, thereby ensuring proper placement of said sock and position-retention thereof when the foot is removed.

6. Comfort sock according to claim 1, wherein said reinforcement of said foot covering of said sock comprises a fastening element ensuring its connection with a portion of an upper edge of the upper of the boot shell.

7. Comfort sock according to claim 1, wherein said support liner connected to said reinforcement of said foot covering and at least one elastic zone of said foot covering designed to cooperate with said liner are positioned on a front portion of said sock located in a matching arrangement with the lower front portion of the lower leg extending substantially to an instep area of said boot.

8. Comfort sock according to claim 1, wherein said support liner connected to said reinforcement of said foot covering and at least one elastic zone of said foot covering intended to cooperate with said liner are provided on a rear portion of the sock located in a matching arrangement with a lower rear portion of the lower leg extending substantially to a heel area of said boot.

9. Comfort sock according to claim 1, comprising an elastically-deformable flexible element arranged on said foot covering for preserving freedom of motion of the lower end of said at least one support liner connected to said reinforcement substantially centered between the two pivoting connections on its wings.

10. Comfort sock according to claim 1, wherein said support liner has connections which make it detachable and interchangeable.

* * * * *